United States Patent [19]

Takagi

[11] Patent Number: 4,569,900

[45] Date of Patent: Feb. 11, 1986

[54] IMAGE RECEIVING MATERIAL FOR SILVER SALT DIFFUSION TRANSFER PROCESS

[75] Inventor: Yoshihiro Takagi, Kanagawa, Japan

[73] Assignee: Fuji Photo Film Co., Ltd., Kanagawa, Japan

[21] Appl. No.: 700,156

[22] Filed: Feb. 11, 1985

[30] Foreign Application Priority Data

Feb. 16, 1984 [JP] Japan ..... 59-27661

[51] Int. Cl.[4] ..... G03C 5/54

[52] U.S. Cl. ..... 430/232; 430/262

[58] Field of Search ..... 430/232, 262

[56] References Cited

U.S. PATENT DOCUMENTS

| | | | |
|---|---|---|---|
| 3,043,691 | 7/1962 | Weyde | 430/232 |
| 3,620,728 | 11/1971 | Cottingham | 430/232 |
| 4,186,013 | 1/1980 | Land et al. | 430/232 |

FOREIGN PATENT DOCUMENTS

| | | | |
|---|---|---|---|
| 687751 | 2/1953 | United Kingdom | 430/232 |

*Primary Examiner*—Richard L. Schilling

*Attorney, Agent, or Firm*—Sughrue, Mion, Zinn, Macpeak and Seas

[57] ABSTRACT

An image receiving material for a silver salt diffusion transfer process comprising a support and at least one image receiving layer, wherein the image receiving layer comprises a binder made up of gelatin, physical development nuclei and polysaccharides having a viscosity of 3 to 200 cp when measured in a 5% aqueous solution at 25° C., with a ratio of the polysaccharides/-gelatin being from about 1/10 to 8/10 by weight, and the same or different image receiving layer comprises a surface active agent represented by the following formula (I):

$$RO(\underset{\underset{CH_3}{|}}{CH_2CHO})_m(CH_2CH_2O)_n(A)_pSO_3M \quad (I)$$

wherein R represents an alkyl group having from 8 to 24 carbon atoms or

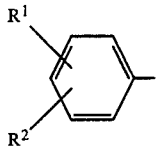

(wherein $R^1$ represents an alkyl group having from 1 to 18 carbon atoms, and $R^2$ represents a hydrogen atom or an alkyl group having from 1 to 18 carbon atoms, provided that the total number of carbon atoms of $R^1$ and $R^2$ is at least 6); A represents an alkylene group having from 2 to 4 carbon atoms; m is an integer of from 0 to 6; n is an integer of 0 to 12; p is 0 or 1; and M represents an alkali metal, an alkaline earth metal, an ammonium group or a substituted ammonium group. The image receiving layer of the image receiving material is brought into face-to-face contact with the exposed silver halide photographic emulsion of a light-sensitive material and processed by a silver salt diffusion transfer process.

The image receiving material according to the invention provides transfer images without marks or shear in transfer, and has superior stripping facility.

5 Claims, No Drawings

IMAGE RECEIVING MATERIAL FOR SILVER SALT DIFFUSION TRANSFER PROCESS

FIELD OF THE INVENTION

The present invention relates to an improved image receiving material for a silver salt diffusion transfer process in which an exposed light-sensitive material and an image receiving material are brought into contact with each other and photographically processed.

BACKGROUND OF THE INVENTION

An element for a silver salt diffusion transfer process comprises, in general, a light-sensitive material comprising a support having thereon light-sensitive silver halide emulsion layers, an image receiving material comprising a support having thereon an image receiving layer containing physical development nuclei, and a processing solution containing a silver halide solvent.

The principle of the silver salt diffusion transfer process is that silver halide present in exposed areas of an exposed light-sensitive layer is developed with a developing agent present either in a processing solution or in the light-sensitive material. At the same time, silver halide present in the unexposed areas reacts with a silver halide solvent contained in the processing solution to form a soluble silver complex salt, and the resulting silver complex salt diffuses into an image receiving layer and is deposited on physical development nuclei present in the image receiving layer to form a silver image.

The silver salt diffusion transfer process described above is applicable to two element embodiments. One is the "monosheet" type in which a light-sensitive layer and an image receiving layer are provided on the same support, and another is the "strip off" type in which a light-sensitive layer and an image receiving layer are provided on separate support. When using the strip off element in a diffusion transfer process, the light-sensitive material and image receiving material are dipped in a processing solution and then they are brought into contact with each other and pressure is applied by means of rollers to effect the diffusion transfer of silver salt image, after which the image receiving material is stripped off from the light-sensitive material. The present invention relates particularly to the latter type of embodiments.

The silver salt diffusion transfer process is employed for reproducing documents, such as technical drawings, printed matter and handwriting, or producing block copies in the photographic mechanical processes. Accordingly, faithful image reproduction of original manuscripts is required in practicing the silver salt diffusion transfer process.

In the case of embodiments of the "strip off" type, it is necessary for a light-sensitive layer to be brought into perfect face-to-face contact with an image receiving layer of an image receiving material in order to achieve uniform diffusion of the silver complex salt. In general, after a light-sensitive material and an image receiving material are dipped in a processing solution, one material is superposed on another material with the supports on the outside and passed through squeegee rollers, as described in U.S. Pat. No. 4,345,019. These steps are all carried out in a development processing apparatus having processing trough and squeegee rollers. In such a process, bubbles in the processing solution often adhere to the surface of the image receiving layer or the light-sensitive layer, and they remain between the light-sensitive layer and the image receiving layer without being completely removed by passing through pressure applying rollers. Poor adhesion or defective permeation of the processing solution occurs in the spots where the bubbles remain to disturb the diffusion transfer of the silver complex salt, and in result, poor transfer areas in the form of fine spots are generated on the resulting image.

In addition, one of the superposed materials can slide across another material upon the slightest touch after passage through the squeegee rollers due to poor adhesiveness between the light-sensitive layer and the image receiving layer, resulting in distortion of the image to be transferred into the image receiving layer (that is, "shear in transfer"). Alternatively, if adhesion between the light-sensitive layer and the image receiving layer is too strong, it is difficult to strip the image receiving material off the light-sensitive material, or the transferred image is damaged by the strip off.

Further, the image receiving material is generally washed for about 5 seconds or longer after the strip off step because developer and other ingredients used for processing remain in the image receiving material stripped off after the processing, and they will cause stains if the material is allowed to stand as it is. However, if a high molecular substance facilitating stripping off, such as carboxymethyl cellulose or the like, is incorporated in the image receiving layer, in the above-described washing step and the subsequent drying step effusion of the high molecular substance from the image receiving layer causes marks shaped like trickle and spots in transferred image areas of the image receiving layer, and color of silver present at the surface of the transferred image is changed partially. Such marks are quite undesirable from the viewpoint of good appearance of transferred image. Particularly when the transferred image serves as a material for block copy in photographing with a camera, and a plate is made using an electrophotomechanical process, such marks can cause a serious problem of unevenness in printing.

The various problems described above constitute the main factors causing the marked deterioration of reproducibility of diffusion transfer images, such as characters and fine lines, and in reproducibility in conversion of continuous tone images into dot images using a contact screen. Therefore, it is strongly desired to eliminate such defects.

The combined use of gelatin and a high molecular substance facilitating strip off in an image receiving layer for the diffusion transfer process is known. Also, saponin and an anionic surface active agent, e.g., an alkylbenzenesulfonic acid, are used as a coating aid. According to our studies, however, it has been found that the problems described above, for instance, generation of poor transfer areas shaped like spots, facility in stripping a light-sensitive material off an image receiving material, generation of marks and so on, are attributable mainly to the image receiving material, in the strict sense, due to an interaction between a binder in the image receiving layer and a surface active agent. This interaction is observed in the microscopic phase separation of a high molecular substance facilitating strip off produced in gelatin binder (by, e.g., increasing the concentration of the high molecular substance in the binder), and in phenomena attended by elution of the high molecular substance facilitating strip off from the surface of the image receiving layer upon washing with water.

SUMMARY OF THE INVENTION

Therefore, a primary object of the present invention is to provide an improved silver salt diffusion transfer material.

Another object of the present invention is to provide an image receiving material for a silver salt diffusion transfer process without the production of poor transfer areas.

A further object of the present invention is to provide an image receiving material for a silver salt diffusion transfer process which has proper adhesion to and is easily stripped off a light-sensitive material, without the production of marks.

The above-described objects are attained by a novel image receiving material for the silver salt diffusion transfer process, in which the image receiving layer is brought into contact with a light-sensitive material having an exposed silver halide photographic emulsion and processed by the silver salt diffusion transfer process.

The image receiving material according to the invention comprises a support and at least one image receiving layer, wherein the image receiving layer comprises a binder comprising gelatin, physical development nuclei and polysaccharides (or derivatives thereof), with the polysaccharides (or derivatives thereof) having a viscosity of about 3 to 200 cp measured in a 5% aqueous solution at 25° C. and with a ratio of the polysaccharides (or derivatives thereof)/gelatin being from 1/10 to 8/10 (by weight), and the same or different image receiving layer comprises a surface active agent represented by the following general formula (I):

$$RO(CH_2\underset{\underset{CH_3}{|}}{C}HO)_m(CH_2CH_2O)_n(A)_pSO_3M \quad (I)$$

wherein R represents an alkyl group having from 8 to 24 carbon atoms or

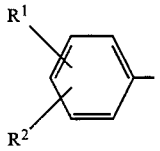

(wherein $R^1$ represents an alkyl group having from 1 to 18 carbon atoms, and $R^2$ represents a hydrogen atom or an alkyl group having from 1 to 18 carbon atoms, provided that the total number of carbon atoms of $R^1$ and $R^2$ is at least 6); A represents an alkylene group having from 2 to 4 carbon atoms; m is an integer of from 0 to 6; n is an integer of from 0 to 12; p is 0 or 1; and M represents an alkali metal, an alkaline earth metal, an ammonium group or a substituted ammonium group.

DETAILED DESCRIPTION OF THE INVENTION

Examples of the surface active agents which are represented by the general formula (I) in the present invention are disclosed in U.S. Pat. No. 3,415,649.

Of the surface active agents represented by the foregoing general formula (I), those represented by the following general formula (II) are preferably employed.

$$RO(CH_2CH_2O)_n(A)_pSO_3M \quad (II)$$

wherein R represents an alkyl group having from 8 to 18

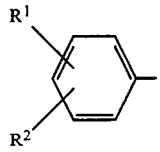

carbon atoms, or

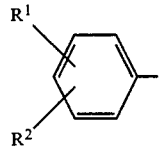

(wherein $R^1$ represents an alkyl group having from 1 to 18 carbon atoms and $R^2$ represents a hydrogen atom or an alkyl group having from 1 to 18 carbon atoms, provided that the total number of carbon atoms of $R^1$ and $R^2$ is at least 6); A represents an alkylene group having from 2 to 4 carbon atoms; n is an integer of from 0 to 10; p is 0 or 1; and M represents an alkali, metal, an alkaline earth metal, or an ammonium group.

Of the surface active agents represented by the above general formula (II), those having the group R represented by

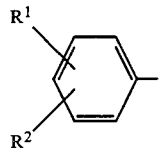

are particularly preferred.

Specific examples of compounds represented by the general formula (I) are illustrated below.

Compound Examples

1. $C_8H_{17}OCH_2CH_2OSO_3 \cdot \frac{1}{2}Ca$
2. $C_{10}H_{21}OCH_2CH_2OSO_3Na$
3. $C_{12}H_{25}OCH_2CH_2OSO_3 \cdot \frac{1}{2}Mg$
4. $C_{12}H_{25}OCH_2CH_2OSO_3Na$
5. $C_{12}H_{25}OCH_2CH_2OSO_3K$
6. $C_{14}H_{29}OCH_2CH_2OSO_3Na$
7. $C_{14}H_{29}O(CH_2CH_2O)_2SO_3Na$
8. $C_{16}H_{33}OCH_2CH_2OSO_3Na$
9. $C_{16}H_{33}O(CH_2CH_2O)_2SO_3Na$
10. $C_{16}H_{33}O(CH_2CH_2O)_3SO_3Na$
11. $C_{18}H_{37}OCH_2CH_2OSO_3Na$
12. $C_{18}H_{37}O(CH_2CH\ _2O)_4SO_3Na$
13. $C_{18}H_{37}O(CH_2CH_2O)_8SO_3Na$

14.

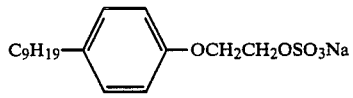

15.

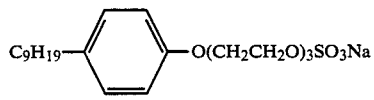

-continued

16.

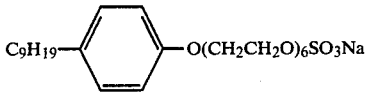

17.

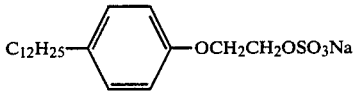

18.

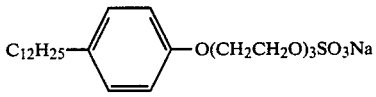

19.

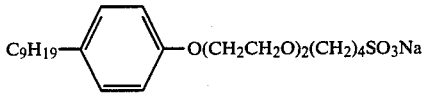

20.

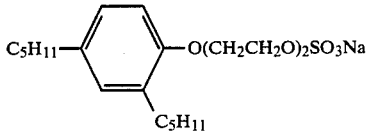

21.

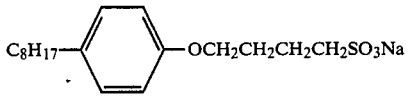

22.

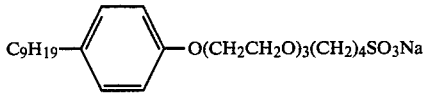

23.

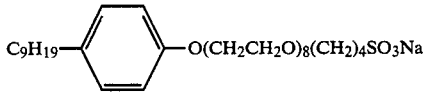

24.

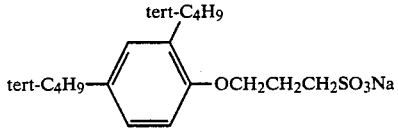

25.

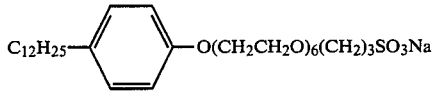

26.

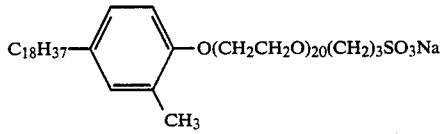

27.

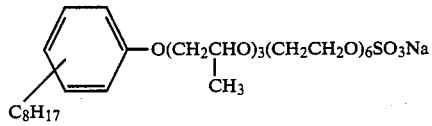

-continued

28.

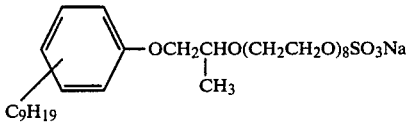

29.

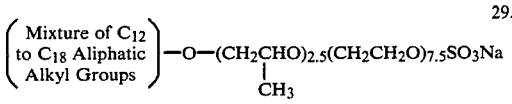

30.

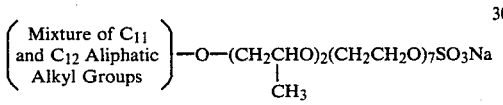

31.

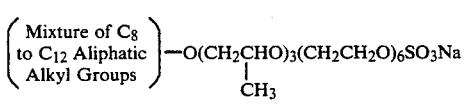

32.

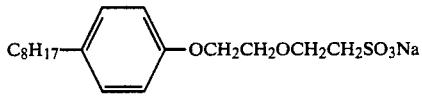

33.

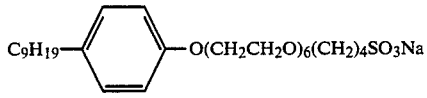

Gelatin which can be used in the present invention is not unduly limited, and includes acid-processed gelatin, lime-processed gelatin, phthalated gelatin, acylated gelatin, phenylcarbamated gelatin and the like. Of these gelatins, lime-processed gelatin and acid-processed gelatin are preferred.

Examples of polysaccharides and derivatives thereof which can be employed in the present invention are disclosed in U.S. Pat. Nos. 3,043,691 and 4,345,019. Specific examples of polysaccharides and derivatives thereof which can be employed in the present invention include Guar Gum, Locust Bean Gum, Carrageenan, Pectin, Algin (e.g., alginic acid and sodium alginate), gum arabic, arabic acid and salts thereof (e.g., the sodium salt and the potassium salt), cellulose derivati,ves (e.g., carboxymethyl cellulose, cellulose sulfates (e.g., the sodium salt, the potassium salt and the quaternary ammonium salt), methyl cellulose, hydroxymethyl cellulose, hydroxyethyl cellulose, hydroxypropyl cellulose, hydroxypropyl cellulose acetate phthalate and hydroxyethylcarboxymethyl cellulose), starch and derivatives thereof (e.g., starch, α-starch, carboxymethyl starch, hydroxypropyl starch, and dialdehydostarch), dextran, dextran sodium sulfate, Pullulan, Xanthan Gum, konjak mannan, Karaya Gum, Gum Ghatti and Gum Tragacanth. Of these substances, carboxymethyl cellulose is preferred.

Polysaccharides and derivatives thereof which can be employed in the present invention have an average molecular weight from about 10,000 to 500,000, preferably from about 20,000 to 100,000.

Polysaccharides and derivatives thereof (hereinafter referred to simply as "polysaccharides") may be used not only alone but also in combination of two or more thereof.

Further, it is desirable to use polysaccharides having a viscosity of about 3 to 200 cp, particularly preferably about 5 to 100 cp, at 20° C. in a 5% aqueous solution.

Water-soluble high molecular compounds other than polysaccharides, such as polyvinyl alcohol, partially saponified polyvinyl alcohol, heat-processed products of polyvinyl alcohol and maleic anhydride copolymers (e.g., styrene-maleic anhydride copolymer and ethylene-maleic anhydride copolymer), polyacrylic acid, poly-N-vinylpyrrolidone, latexes (e.g., homo- or copolymers of acrylic acid esters, methacrylic acid esters, styrene or butadiene), and so on, can be incorporated in an image receiving layer or a layer adjacent thereto.

A suitable ratio of gelatin to polysaccharides ranges from about 0.1 to 0.8 (by weight), particularly preferably from about 0.1 to 0.6 (by weight).

It is desirable for the image receiving layer to have a gelatin coverage of about 0.5 g/m$^2$ to about 2.8 g/m$^2$. If the gelatin coverage is less than about 0.5 g/m$^2$, transferred silver deposits at the surface of the image receiving layer because the layer thickness is too thin, and the transferred silver image has a metallic luster. On the other hand, if the gelatin coverage is more than about 2.8 g/m$^2$, the image receiving layer tends to generate stains resulting from processing agents or oxidation thereof after strip off, or the rate of transfer is decreased.

A thickness of the image receiving layer ranges from about 0.5 $\mu$m to about 3 $\mu$m.

In one preferred embodiment, the photographic element for the silver salt diffusion transfer process in which the image receiving material of the present invention is employed comprises (1) a light-sensitive material comprising a silver halide photographic emulsion layer, (2) an image receiving material comprising an image receiving layer containing physical development nuclei, and (3) a processing composition for diffusion transfer. In a further preferred embodiment, the silver halide light-sensitive material contains a developing agent.

In one embodiment, the processing composition for diffusion transfer may fill in a rupturable pod. However, this embodiment is not preferred.

In a more preferred embodiment, the light-sensitive material comprises a support having provided thereon an antihalation layer containing a carbon black dispersion and/or a dye and a silver halide photographic emulsion layer, the image receiving material comprises a second support having provided thereon an image receiving layer containing physical development nuclei and so on, and a processing composition for diffusion transfer is spread between the light-sensitive material and the image receiving material. Particularly preferably, a developing agent is incorporated in the antihalation layer.

In the most preferred embodiment, a light-sensitive material and the layer construction thereof are described in *Photographic Silver Halide Diffusion Process*, A. Rott & E. Weyde, eds., page 78, line 7, "Copyrapid Dry".

The silver halide photographic emulsion which can be employed in the present invention comprises silver halide dispersed in a hydrophilic colloidal substance. Silver halides which can be present in the silver halide photographic emulsion layer include silver chloride, silver chlorobromide, silver bromide, silver iodobromide and silver iodochlorobromide.

In order to form images of excellent sharpness and high contrast, preferred silver halide compositions are silver chlorobromide or chlorobromoiodide, more preferably those containing about 0.1 to about 9, preferably about 0.5 to about 5, mol % bromide, 0 to about 0.2, preferably 0 to 0.1, mol % iodide, and the remainder chloride. The ratio of hydrophilic colloid content (by weight) to silver halide content (by weight based on silver nitrate) in the silver halide emulsion ranges from about 0.1 to about 3.0, preferably from about 0.3 to about 2.5, more preferably from about 0.5 to about 2.3.

The present invention is not particularly restricted as to grain size of the silver halide emulsion to be used. However, a suitable grain size of the silver halide ranges from about 0.1 to 3.0 microns, preferably from about 0.1 to 0.5 micron.

Silver halides which can be used in the present invention can contain a trace amount of heavy metal, such as Rh, Pd, Ir, Pb, Ni, Cu, Zn, Au or the like. The silver halide emulsion can be chemically sensitized by using as a sensitizer a sulfur sensitizer, a gold sensitizer or a combination thereof. In addition, the silver halide emulsion is generally sensitized in the wavelength range of about 530 nm to about 560 nm. Further, the emulsion may be sensitized panchromatically.

The silver halide emulsion layer and/or the image receiving layer may contain any compounds which are conventionally used for practicing the silver salt diffusion transfer process. Examples of such compounds include an antifoggant such as tetraazaindenes or mercaptotetrazoles, a coating aid such as polyalkylene oxides, a hardener such as formalin or chrome alum, a plasticizer, and so on. Preferable amount of the coating aid is from about 0.0001 to about 0.3 g/m$^2$, preferable amount of the hardener is from about 0.01 to about 1 g/m$^2$ and preferable amount of the plasticizer is from about 0.1 to about 10 g/m$^2$. The support to be used in the light-sensitive material, the image receiving material, or the so-called monosheet which combines these materials may be any conventionally used one. Examples of suitable supports include paper, glass, films such as a cellulose acetate film, a polyvinyl acetal film, a polystyrene film, or a polyethylene terephthalate film, a metal support coated with paper on both sides thereof, and a paper support coated with an $\mu$-olefin polymer, e.g., polyethylene, on one side or both sides thereof, In the present invention, one or more developing agents selected from each of hydroquinones and 3-pyrazolidinones can be used. Preferably the combined use of hydroquinones and 3-pyrazolidinones, such as hydroquinone and 4-hydroxymethyl-4-methyl-1-p-tolyl-3-pyrazolidinone, hydroquinone and 4-hydroxymethyl-4-methyl-1-phenyl-3-pyrazolidinone, hydroquinone and 4,4-dihydrozymethyl-1-phenyl-3-pyrazolidione, or hydroquinone and 4,4-dihydroxymethyl-1-p-tolyl-3-pyrazolidinone, can be used.

The content of hydroquinones in the photographic material is from about 0.06 mol to about 6.3 mols, preferably from about 0.1 mol to about 1.5 mols, per mol of silver. Similarly, the content of pyrazolidinones is from about 0.006 mol to about 0.6 mol, preferably from about 0.02 mol to about 0.16 mol, per mol of silver.

The image receiving layer employed in the present invention contains physical development nuclei in addition to gelatin, polysaccharides and the surface active agent of the general formula (I). Further, it can generally contain a toning agent and, optionally, a whiteness-increasing agent such as a brightening agent, a stain inhibitor such as boric acid, a hardening agent and so on.

Any known physical development nuclei, for example, heavy metals such as zinc, mercury, lead, cadmium, iron, chromium, nickel, tin, cobalt, copper, etc., noble metals such as palladium, platinum, silver, gold, etc., and sulfides, selenides or tellurides of these metals, can be employed in the present invention. These physical development nucleus substances can be obtained by preparing a metallic colloid dispersion through reduction of the corresponding metal ion, or by preparing a colloidal dispersion of water-insoluble metal sulfide, selenide or telluride by mixing a metal ion solution with a water-soluble sulfide, selenide or telluride.

The function of the physical development nucleus substance is described in, e.g., U.S. Pat. No. 2,774,667, Land et al (Dec. 18, 1956). In order to obtain an image receiving element capable of providing images of high contrast, these physical development nuclei are incorporated in an image receiving layer at a coverage of about $10^{-10}$ to $10^{-5}$ g/cm$^2$, preferably about $10^{-8}$ to $10^{-6}$ g/cm$^2$.

In the image receiving material of the present invention, it is desirable to incorporate a toning agent into the image receiving layer containing physical development nuclei, i.e., a compound capable of changing the tone of the color inherent in a silver transfer image formed after photographic processing.

Examples of toning agents which can be effectively used include imidazolidine-2-thione, perhydrodiazine-2thione, mercaptobenzimidazoles (such as 2-mercaptobenzimidazole, 2-mercapto-5-methylbenzimidazole or 2-mercapto-5-chlorobenzimidazole), mercaptoimidazoles (such as 2-mercaptoimidazole, 2-mercapto-4-phenylimidazole, 1-methyl-2-mercapto-5-phenylimidazole, 1-benzyl-2-mercapto-imidazole or 2-mercapto-1-phenylimidazole), mercaptotriazoles (such as 3-mercapto-4, 5-dimethyltriazole or 4-p-toluyl-4H-1, 2, 4-triazole-3-thiol), mercaptobenzotriazoles (such as benzotriazole-2-thiol), tetrazole-5-thiols (such as 1-phenyl-5-mercaptotetrazole or 1-ethyl-5-mercapto-1H-tetrazole), mercaptopyrimidines (such as 2-mercaptopyrimidine, 2, 4-dimercaptopyrimidine or 4-hydrozy-2, 6-dimercaptopyrimidine), and tetrazapentalenes (such as 1, 4-dimercapto-3H,6H-2, 3a,5, 6a-tetrazapentalene or 3, 6-diphenyl-1, 4-dimercapto-3H,6H-2, 3a,5, 6a-tetrazapentalene).

Though a suitable amount of the toning agent to be added depends on the compound used, the addition of too little toning agent results in formation of a silver transfer image having a reddish-black tone, while the addition of an excess amount renders the tone of the image leadenness or causes a decrease in overall optical density. Therefore, the coverage of the toning agent is generally within the range of about $10^{-9}$ to about $10^{-4}$ mol/m$^2$, preferably about $10^{-7}$ to $10^{-5}$ mol/m$^2$.

Of the above-described toning agents, mercaptoimidazoles and mercaptotetrazoles are preferred.

The image receiving material of the present invention can also contain a silver halide solvent such as potassium thiosulfate or sodium thiosulfate.

The foregoing developing agent, though preferably incorporated in a silver halide emulsion layer and/or a layer adjacent thereto, may also be incorporated in an image receiving layer and/or a layer adjacent thereto.

Preferred embodiments of the present invention are further described in more detail below. A light-sensitive material for the silver salt diffusion transfer process comprises a support having provided thereon at least one silver halide emulsion layer containing silver halide in a coverage of about 0.5 to 3.5 g/m$^2$ based on silver nitrate. In addition to this silver halide emulsion layer, the light-sensitive material, if necessary, may have a subbing layer, an interlayer, a protective layer, a stripping off layer and other conventional auxiliary layers. For instance, a covering layer containing a binder having water permeability as described in Japanese Patent Publication Nos. 18134/63 and 18135/63, such as methyl cellulose, a sodium salt of carboxymethyl cellulose or sodium alginate may be provided on the silver halide emulsion layer in the light-sensitive material to be used in the present invention for the purpose of achieving the uniform transfer of silver salt image. This covering layer should be thin, e.g., from about 0.05 μm to 0.5 μm so that the diffusion of a silver complex salt is not substantially inhibited or restrained. Every silver halide emulsion layer present in the light-sensitive emulsion layer contains one or more of a hydrophilic colloidal substance, such as gelatin, gelatin derivatives such as phthalated gelatin, cellulose derivatives such as carboxymethyl cellulose or hydroxymethyl cellulose, dextrin, soluble starch or colloidal dispersions of hydrophilic synthetic high polymers such as polyvinyl alcohol or polystyrenesulfonic acid.

A processing composition for effecting the silver salt diffusion transfer processing of the present invention can contain alkaline substances, such as sodium hydroxide, potassium hydroxide, lithium hydroxide or sodium tertiary phosphate; a preservative, such as sodium sulfite; a viscosity-increasing agent, such as carboxymethyl cellulose or hydroxyethyl cellulose; an antifoggant, such as potassium bromide; a silver halide solvent, such as sodium thiosulfate; a toning agent, such as 1-phenyl-5-mercaptotetrazole; a surface active agent, such as a polyoxyalkylene compound, an alkylbenzenesulfonic acid or an onium compound; development nuclei. such as those described in British Patent 1,001,558; and a developing agent as described hereinbefore, if desired. The pH of the processing solution is adjusted to a value which activates development, i.e., in the range of about 9.5 to 14, preferably about 10 to 13.0. The optimum pH of the processing composition for a specific diffusion transfer process varies depending upon the nature of the photographic material used, the image quality desired, the kinds and contents of various compounds present in the processing composition used, and so on.

In addition, the processing composition can contain a toning agent. Suitable examples of the toning agent include the compounds that can be added to the image receiving material.

Although a suitable addition amount of such a toning agent depends on the kind of compound used, it is typically within the range of about $1.5 \times 10^4$ to $10^{-3}$ mol per liter of the processing composition.

Of the above-described toning agents, mercaptotetrazoles are preferably added to the processing, composition.

In accordance with embodiments of the present invention as described above, the following effects can be produced.

(1) Poor transfer areas due to bubbles, unsatisfactory dipping of the processing solution and so on are not formed in the image receiving material and, therefore, a transferred image having an excellent appearance is obtained.

(2) Adhesiveness between the light-sensitive layer and the image receiving layer is improved and sliding of the image receiving material on the light-sensitive material is eliminated, thus preventing the so-called shear in transfer.

(3) Spot shaped marks and the like are not produced upon washing with water. This is probably due to uniform elution of polysaccharides facilitating stripping off, such as carboxymethyl cellulose, upon washing. In the absence of marks, the problem of unevenness which is encountered in making an electrophotomechanical process can be solved.

The above-described effects cannot be obtained if a ratio of polysaccharides to gelatin is smaller than about 0.1 by weight or larger than about 0.9 by weight.

The invention is described in greater detail with reference to the following example, which is not to be construed as limiting the scope thereof. Unless otherwise indicated, all parts, percents and ratios are by weight.

EXAMPLE 1

On one side of a paper support which was coated with polyethylene on both sides, and had a basis weight of 110 g/m$^2$, an image receiving layer comprising gelatin, in which metallic palladium nuclei which were prepared by reference to *Photographic Silver Halide Diffusion Processes,* A. Rott & E. Weyde, eds., page 56, lines 11 to 16 were incorporated, and carboxymethyl cellulose was coated at a coverage of 2 g/m$^2$ based on dried gelatin to prepare an image receiving material. The weight ratio of carboxymethyl cellulose to gelatin and surface active agent added are set forth in Table 1.

The thus prepared light-sensitive material was covered with a 100-line magenta contact screen, and exposed to light through a continuous wedge for sensitometry. After the light-sensitive material and the above-described image receiving material are dipped in the processing composition for the silver salt diffusion transfer process which was kept at about 23° C., the emulsion surface of the light-sensitive material was brought into face-to-face contact with the image receiving surface of the image receiving material and contained the ingredients in amounts described below, after which the resulting sandwich was passed through a pair of squeegee rollers. After 30 sec, these materials were stripped off. The thus processed image receiving material was washed with water for 1 minute, and air dried. The transfer image obtained was a dot image, and contained a white area, a black area and a medium tone area.

| Processing Composition for Diffusion Transfer Process: | |
|---|---|
| $H_2O$ | 800 ml |
| $Na_3PO_4.12H_2O$ | 75 g |
| $Na_2SO_3$ | 40 g |
| KBr | 0.5 g |
| $Na_2S_2O_3$ | 20 g |
| 1-Phenyl-5-mercaptotetrazole | 70 mg |
| N—Methylaminoethanol | 10 g |
| Water to make | 1 l |

The transfer images obtained were examined for water marks and shift of dots (shear in transfer).

As can be seen from the data in Table 1, the samples of the present invention achieved good results.

TABLE 1

| Sample | Ratio of CMC* to Gelatin (by wt.) | Surface Active Agent (Example No.) | Amount Added (mol/g gelatin) | Gelatin Coverage (g/m$^2$) | Marks | Shear in Transfer | Stripping Facility | Remark |
|---|---|---|---|---|---|---|---|---|
| A | 0.9 | 22 | $3 \times 10^{-4}$ | 2.0 | C | C | $C_2$ | Comparison |
| B | 0.8 | 22 | " | " | B | B | A | Invention |
| C | 0.6 | 22 | " | " | B | B | A | " |
| D | 0.4 | 22 | " | " | B | A | A | " |
| E | 0.2 | 22 | " | " | A | A | A | " |
| F | 0.1 | 22 | " | " | A | A | A | " |
| G | 0.05 | 22 | " | " | A | A | $C_1$ | Comparison |
| H | 0.2 | 15 | " | " | A | A | A | Invention |
| I | " | 33 | " | " | A | A | A | " |
| J | " | Comparison 1* | " | " | C | A | A | Comparison |
| K | " | Comparison 2* | " | " | C | A | A | " |

CMC*: Carboxymethyl Cellulose,

Comparison 1*: Sodium dodecylbenzenesulfonate,

Comparison 2*: $NaO_3S—CH(CH_2COOCH_2CH(C_2H_5)C_4H_9)COOCH_2CH(C_2H_5C_4H_9$

The carboxymethyl cellulose used had an average molecular weight of about 50,000 and a viscosity of 2.5 cp (at 20° C.) when measured in a 5% aqueous solution.

On one side of another polyethylene-coated paper support of the same kind used in the image receiving material were coated, in sequence, a gelatin layer for antihalation which contained 0.25 g/m$^2$ of carbon black, 0.8 g/m$^2$ of hydroquinone and 0.2 g/m$^2$ of 4-hydroxymethyl-4-methyl-1-phenyl-3-pyrazolidinone (at a gelatin coverage of 4 g/m$^2$) and an orthochromatically sensitized gelatin-silver chlorobromide emulsion layer which contained silver chlorobromide grains (Br content: 2 mol %) having a mean grain size of 0.3 micron at a 1 coverage of 2.0 g/m$^2$ based on silver nitrate to prepare a light-sensitive material.

In the foregoing table, marks were evaluated by three grades, A, B and C. Grade A means that the transferred image had no marks, grade B means that marks were observed in limited numbers, and grade C means that a number of marks were observed. Grades A and B indicate a substantially allowable level. Shear in transfer is also represented by three grades, A, B and C. Grade A means that no shear in transfer occurred, grade B means that shear in transfer occurred to some extent, and grade C means that it occurred to a considerable extent. Only grade A indicates a substantially allowable level. Also, the stripping facility was graded by A, $C_1$ and $C_2$. Grade A means that the stripping facility was optimum, grade $C_1$ means that the image receiving material was too hard to strip off, and grade $C_2$ means that the image receiving material was too soft to strip off. Only grade A indicates a substantially allowable level.

While the invention has been described in detail and with reference to specific embodiments thereof, it will be apparent to one skilled in the art that various changes and modifications can be made therein without departing from the spirit and scope thereof.

What is claimed is:

1. An image receiving material for a silver salt diffusion transfer process comprising a support and at least one image receiving layer, wherein the image receiving layer comprises a binder comprising gelatin, physical development nuclei and polysaccharides or gelatin, physical development nuclei and polysaccharide derivatives, with the polysaccharides or polysaccharide derivatives having a viscosity of about 3 to 200 cp measured in a 5% aqueous solution at 25° C and with a ratio of the polysaccharides or polysaccharide derivatives/gelatin being from about 1/10 to 8/10 (by weight), and the same or different image receiving layer comprises a surface active agent represented by the following general formula (I):

$$RO(CH_2\underset{\underset{CH_3}{|}}{C}HO)_m(CH_2CH_2O)_n(A)_pSO_3M \qquad (I)$$

wherein R represents an alkyl group having from 8 to 24 carbon atoms or

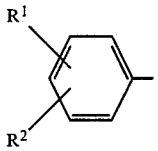

(wherein $R^1$ represents an alkyl group having from 1 to 18 carbon atoms, and $R^2$ represents a hydrogen atom or an alkyl group having from 1 to 18 carbon atoms, provided that the total number of carbon atoms of $R^1$ and $R^2$ is at least 6); A represents an alkylene group having from 2 to 4 carbon atoms; m is an integer of from 0 to 6; n is an integer of from 0 to 12; p is 0 or 1; and M represents an alkali metal, an alkaline earth metal, an ammonium group or a substituted ammonium group.

2. The image receiving material claimed in claim 1, wherein said surface active agent is represented by the following general formula (II):

$$RO(CH_2CH_2O)_n(A)_pSO_3M \qquad (II)$$

wherein R represents an alkyl group having from 8 to 18 carbon atoms, or

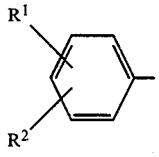

(wherein $R^1$ represents an alkyl group having from 1 to 18 carbon atoms and $R^2$ represents a hydrogen atom or an alkyl group having from 1 to 18 carbon atoms, provided that the total number of carbon atoms contained in $R^1$ and $R^2$ is at least 6); A represents an alkylene group having from 2 to 4 carbon atoms; n is an integer of from 0 to 10; p is 0 or 1; and M represents an alkali metal, an alkaline earth metal, or an ammonium group.

3. A photographic light-sensitive material for a silver salt diffusion transfer process comprising the image receiving material claimed in claim 1, a light-sensitive material comprising a second support and silver halide photographic emulsion layer, and means for providing a processing composition for diffusion transfer between said image receiving material and said light-sensitive material.

4. The photographic light-sensitive material claimed in claim 3, wherein said silver halide photographic emulsion comprises silver chlorobromide or silver chlorobromoiodide, having a halide composition of from about 0.1 to 9 mol % bromide, from 0 to about 0.2 mol % iodide, the remainder being chloride.

5. The photographic light-sensitive material claimed in claim 4, wherein said silver chlorobromide or chlorobromoiodide has a halide composition of from about 0.5 to 5 mol % bromide, from 0 to about 0.1 mol % iodide, the remainder being chloride.

* * * * *